United States Patent [19]

Grossmann

[11] Patent Number: 4,895,187

[45] Date of Patent: Jan. 23, 1990

[54] PICKING DEVICE FOR THE PICKING MOTION OF A LOOM

[75] Inventor: Hans Grossmann, Heidenheim, Fed. Rep. of Germany

[73] Assignee: Hermann Wangner GmbH & Co. KG, Fed. Rep. of Germany

[21] Appl. No.: 259,368

[22] Filed: Oct. 18, 1988

[30] Foreign Application Priority Data

Oct. 19, 1987 [DE] Fed. Rep. of Germany ..... 3735353

[51] Int. Cl.[4] ..... D03D 49/48

[52] U.S. Cl. ..... 139/145

[58] Field of Search ..... 139/142, 145

[56] References Cited

U.S. PATENT DOCUMENTS 2,160,339 6/1939 Moessinger ..... 139/145
2,615,474 10/1952 BatlloIbanez ..... 139/145
2,813,549 11/1957 Pfarrwaller ..... 139/145

FOREIGN PATENT DOCUMENTS 717688 10/1966 Italy ..... 139/145

*Primary Examiner*—Henry S. Jaudon
*Attorney, Agent, or Firm*—Sughrue, Mion, Zinn, Macpeak & Seas

[57] ABSTRACT

A picking device for the picking motion of a loom uses a pull string for delivering the picking energy to a pivot arm which is capable of being tensioned by way of a cam drive. The pull string can in principle be any elongate structure, e.g. a pull string of steel or a rope of high tenacity aramide fibers. The cam drive includes a toggle lever which is extended by a first cam and urged somewhat beyond its dead center, and which is urged by a second cam back over the dead center to initiate picking. A decelerating string is connected to the pivot arm to decelerate the pivot arm at the end of the pick.

7 Claims, 5 Drawing Sheets

PICKING DEVICE FOR THE PICKING MOTION OF A LOOM

BACKGROUND OF THE INVENTION

The invention relates to a picking device for the picking motion of a loom, which generally is a shuttle. The picking device includes a spring for delivering picking energy to a pivot arm wherein the spring is adapted to be tensioned by way of a cam drive.

In looms having more than 6 m product width, which are presently in use, the pivot arm of the picking device is driven by a cam without accumulation of the energy required for the pick in an energy accumulator.

Picking devices with storage of the energy required to move the shuttle have been disclosed in German Patent No. 30 819 and German Patent No. 47 088 where tension springs made of steel are employed.

In German Patent No. 822 827, a picking device is disclosed where the energy set free in decelerating the shuttle is stored and reused for driving the shuttle.

A picking device of the generic type is disclosed in German Patent Publication No. 27 42 088. The cam is supported for free rotation and is driven by a one-way drive clutch. Due to a descending curve portion the cam leads relative to the drive shaft within a coupling cycle as the energy for the picking motion is released. By a return motion stop means the return motion of the cam within the coupling cycle is avoided. This picking device offers an advantage over a picking device where the impact lever is driven directly by a cam, without interposed energy storage, up to product widths of only six meters.

In a Sulzer loom disclosed in the book "*Weberei*" by J. Schneider, Springer-Verlag 1961, the torsion bar is tensioned by way of a toggle lever stretched by a cam which is driven by the main shaft of the loom. The end of the toggle lever remote from the torsion bar is connected to the loom frame through a shock absorber.

In practice, it has become obvious that by the acceleration of the pivot arm, of the energy accumulator (spring) and the elements of the cam drive, and by friction in the picking device, about 4/5 of the accelerating energy released by the energy accumulator is lost. Furthermore, it must be borne in mind that the energy accumulator may release only 54% of the stored energy in the acceleration phase.

SUMMARY OF THE INVENTION

It is the object of the invention to so improve a picking device of the generic type that it increases the operating speed even of looms with very great product widths.

According to the invention, this object is realized in that the spring is a pull string. The term "pull string" as used herein is meant to encompass every rod, bar, or cable-like element. Preferably the pull string is a rope of high tenacity aramide fibers, especially fibers of poly(p-phenylene terephthalamide) (KEVLAR 29). Yet, the pull string may also be a metal bar consisting especially of titanium, aluminum or high-strength steel. It is essential that the material of the pull string exhibits an elasticity modulus as low as possible combined with high tenacity and low specific weight, so that the pull string, with predetermined spring excursion and predetermined maximum force, has minimum weight in order to be able to transmit a maximum of energy to pivot arm. KEVLAR 29 is a well suited material primarily because it has a high permanent swelling resistance combined with low elastic modulus and low specific gravity.

It has been found that a pull string is capable of transmitting to the picking device a higher proportion of the stored energy than a torsion bar or a coil spring. This is so regardless of the material. Although a torsion bar is more favorable than a coil spring, it has the disadvantage that it must be installed across the direction of picking. Torsion bars having high energy storing capacity, as required for broad looms, would have a length greater than the dimensions of the loom.

Preferably the cam drive includes a toggle lever having one end linked to the pivot arm at a point spaced from the pivot point of the arm which, for tensioning the pull string, is urged by a first cam beyond its dead center and for initiating picking, is urged back beyond the dead center by a second cam. Such a toggle lever does not substantially increase the mass to be accelerated during picking. Moreover, the toggle lever itself is accelerated to only a relatively low speed.

Part of the kinetic energy remaining in the toggle lever after picking is received preferably by a decelerating string fastened to the pivot arm at a point spaced from its pivot point and decelerating the pivot arm at the end of the pick. Suitably the decelerating string has a stop near the pivot arm which, when the pull string is tensioned, bears against an abutment so that the forward part of the decelerating string near the pivot arm is free of tension from the tensioned pull string, while the rearward part of the decelerating string remote from the pivot arm is prestressed. As the pivot arm is decelerated the stop mounted on the decelerating string is lifted off the abutment so that the prestress acts as a decelerating force.

In order to prevent vibration of the picking motion a shock absorber responsive unilaterally only to pressure is mounted preferably on the stop. The piston rod of the shock absorber is pulled, while the decelerating string slows down the pivot arm. After deceleration the pivot arm has a tendency to snap back. The stop is pulled back by the decelerating string whereby the piston rod of the shock absorber is pushed.

The picking motion of the invention can be used with gripper shuttles receiving the weft thread after having been shot off, and with elastic shuttles receiving the weft thread at stand-still before being shot off. In contrast to picking motions where the shuttle is accelerated in a curve by drive belts, they require very little time. The pivot arm is released only shortly before the moment of shooting so that upon quick shut-down of the loom any undesirable shuttle propulsion can be avoided.

Pull strings consisting of aramide fibers have a very high energy storing capacity combined with light weight. This allows the acceleration of relatively heavy shuttles up to 200 g to a speed higher than the speed achievable with other picking motions.

BRIEF DESCRIPTION OF THE DRAWINGS

An example of the invention will now be explained with reference to the drawings in which.

DETAILED DESCRIPTION OF THE INVENTION

Figure 1:
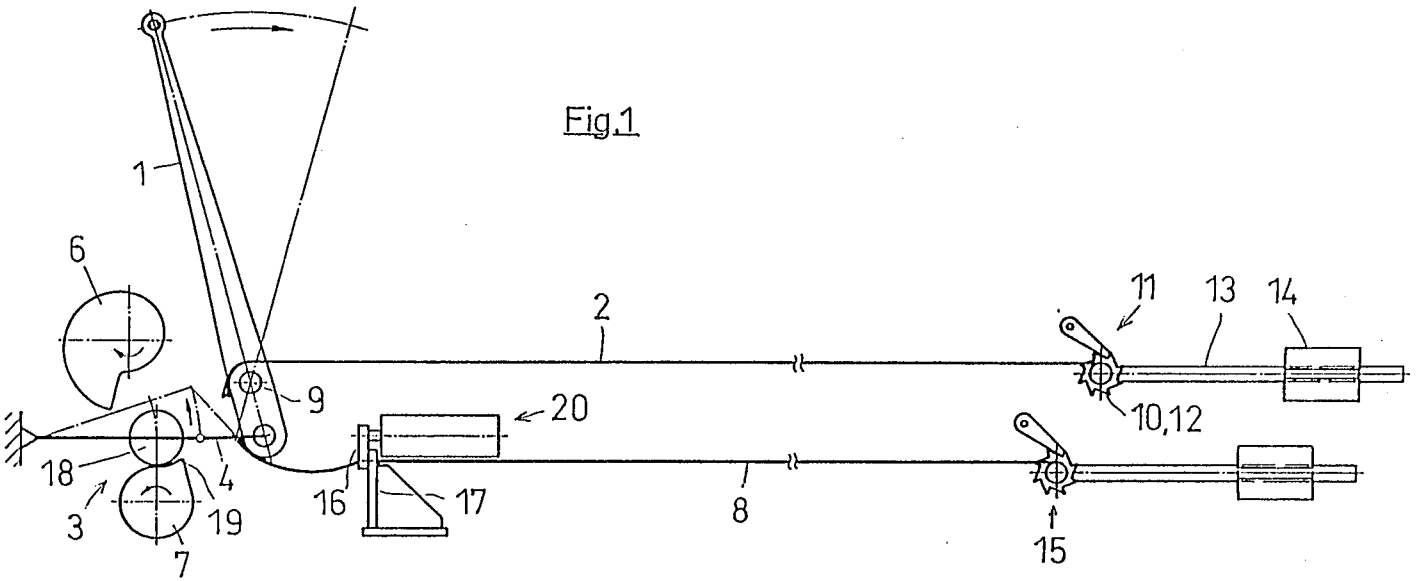
FIG. 1 shows a basic sketch of the picking motion prior to the propulsion of the shuttle, with tensioned pull string.

FIG. 1 merely shows the essential parts of a picking motion. The loom is otherwise of known construction and not shown. The picking motion comprises a pivot arm 1 supported for pivoting about a pivot point 9. Above the pivot point 9 the pivot arm 1 is engaged by a pull string 2 of aramide fibers which tends to rotate the pivot arm 1 in a clockwise direction in FIG. 1. The other end of the pull string 2 is fastened to the frame of the loom. For adjustment of the length and tension force the other end is wound onto a roll 10 supported with a return motion stop means 11 on a shaft 12. By a tensioning lever 13 radially extending away from the shaft 12 and bearing a slidable weight 14 the tensioning force of the pull string 2 can be varied. Furthermore, the pivot arm 1 is engaged by a decelerating string 8 on the other side of the pivot pint 9, i.e. below the pivot point 9. The other end of the decelerating string 8 has a similar tensioning means 15 as the pull string 2. In the vicinity of the pivot arm 1, stop 16 is fastened to the decelerating string 8 and bears against an abutment 17 and lifts off the abutment 17 during deceleration.

The motion of the pivot arm 1 is controlled by way of a toggle lever 4 by two cams 6 and 7. One arm of the toggle lever is connected to the pivot arm 1 while the other one is linked to the frame of the loom. In the vicinity of the point of articulation of the toggle lever 4 a roll 18 is located which is moved by the cams 6 and 7. The toggle lever 4 is suitably linked to the pivot arm 1 in the vicinity of the pivot point 9 in order that its movement consumes a minimum of energy.

The first cam 6 serves to tension the pull string 2 and has an approximately spiral periphery with one step. It is arranged above the toggle lever 4 and urges it downwardly beyond its dead center. The toggle lever 4 is thereby stretched and urges the pivot arm 1 counterclockwise to the left. The second cam 7 has a circular periphery with one nose 19 and is so arranged that the roll 18 on the toggle lever 4 bears against the circular peripheral portion of the second cam 7 when the toggle lever 4 is moved beyond its dead center slightly in downward direction. Both cams 6, 7 are driven by the main shaft of the loom.

When the pivot arm 1 is in its extreme left position where the pull string 2 is tensioned (FIG. 1) the shuttle (not shown) is placed before the tensioned pivot arm 1. The second cam 7 has meanwhile rotated so far that the nose 19 urges the toggle lever 4 beyond its dead center upwardly so that the pivot arm 1 snaps toward the right and accelerates the shuttle. After an acceleration path of 150 mm, for example, the maximum velocity is reached and the decelerating string 8 starts to become active. The stop member 16 fastened to the decelerating string 8 lifts off from the abutment while the prestress adjusted by the tensioning means 15 acts as decelerating force. The pivot arm 1 is decelerated on its further path of motion within about 130 millimeters.

In order to prevent vibration of the system a shock absorber is provided at the abutment 17. The shock absorber reacts unilaterally only to pressure and its piston rod 21 is connected to the stop 16. As mentioned before, the stop 16 lifts off the abutment 17 as the pivot arm 1 is decelerated. Thereby the piston rod 21 is drawn out of the cylinder of the shock absorber 20. Since the shock absorber 19 reacts only to pressure this does not require much energy. After deceleration the tensioned decelerating string 8 seeks to pull the pivot arm 1 back, i.e. when seen in FIG. 2 to rotate it counterclockwise. However, the piston rod 21 of the shock absorber 20 is urged back into the cylinder so that the decelerating string 8 must act against the shock absorber 20 as the pivot arm 1 is returned. Thus, the shock absorber suppresses vibration of the pivot arm 1.

The places where the pull string 2 and the decelerating string 8 are secured can be selected to be other than as shown in the Figures. They are so selected that they exert opposite torque on the pivot arm 1. Also, the positions of the two cams 6, 7 can be selected differently.

Figures 3, 4:
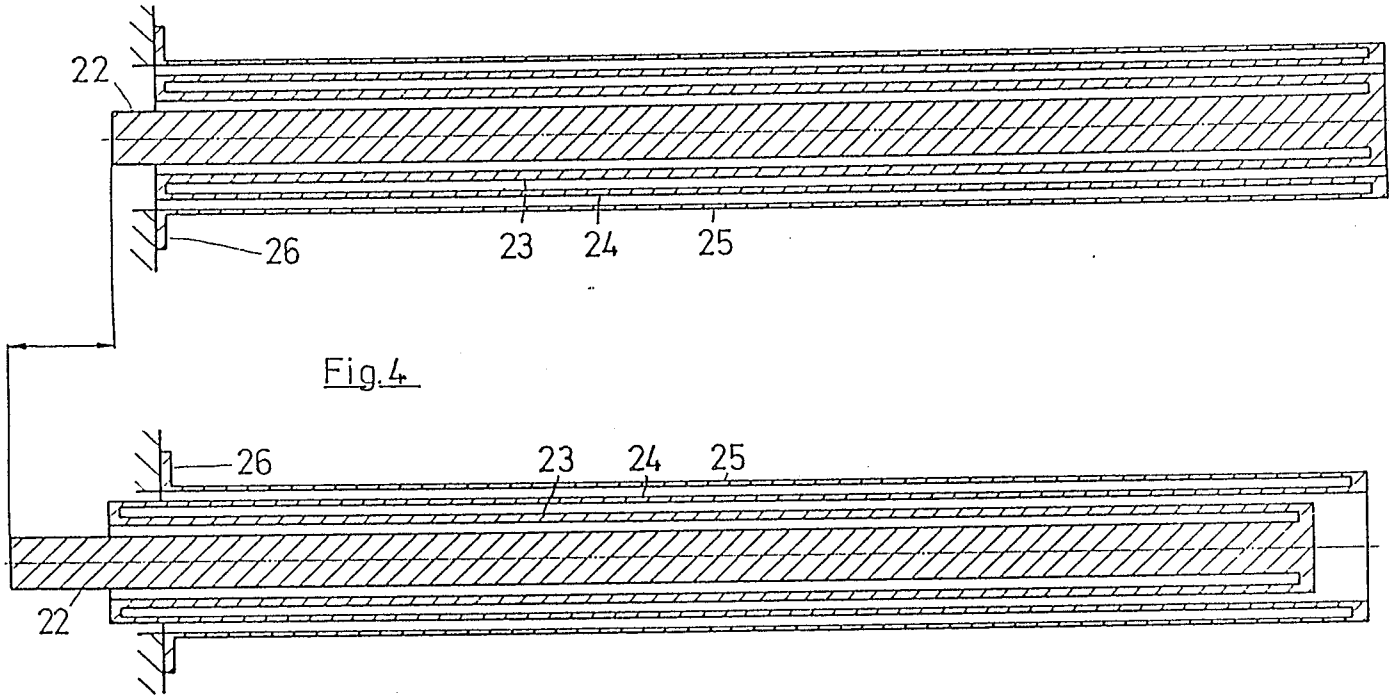
FIG. 3 is a cross section through a pull string composed of a rod and a plurality of tubes in unstressed state.
FIG. 4 shows the pull string of FIG. 3 in stressed state.

A pull string in the form of solid pull rod must be of very great length in view of the low elongation of about 0.3 to 1% of metal so that space problems will arise in installing such a rod in the loom. FIGS. 3 and 4 show an embodiment of a pull string of substantially shorter overall length and equal energy storing capacity. The pull string 2 shown in FIGS. 3 and 4 consists of a central tension rod 22 around which tubes 23, 24 and 25 of increasingly larger diameters are concentrically arranged with sufficient space between the tension rod 22 and the tubes so that the tension rod and tubes can slide lengthwise without mutual contact. The tension rod 22 is welded to the first tube 23 at the rear end (the right-hand end in FIGS. 3 and 4). Otherwise the tension rod 22 and the first tube 23 do not contact each other. The first tube 23 is surrounded by a second tube 24 and is welded to the latter at the forward end. Otherwise the first and the second tube 23 or 24, respectively, do not contact each other. The second tube 24 is surrounded by a third tube 25 and is welded thereto at the rear end. Otherwise these two tubes 24, 25 do not contact each other. At the forward end the third tube 25 has an outwardly radially projecting annular flange 26 which serves to secure the pull string 2 to the frame of the loom. The tubes 23, 24 and 25 have equal lengths. The front end of the tension rod 22 extends from the tubes 23, 24 and 25 and is linked at its forward end to the pivot arm 1. When the pivot arm 1 is tensioned, the pull string 2 is put under load, as shown in FIG. 4. The tension rod 22 and the second tube 24 are then subjected to tension, while the first and the third tubes 23 and 25 are subjected to pressure. In order to achieve uniform load on the tension rod 22 and the three tubes 23, 24 and 25 the cross sectional area of the tension rod 22 and the annular cross sectional area of the three tubes 23, 24 and 25 should be equal. The wall thickness of the three tubes 23, 24 and 25 therefore decreases from the inside outwardly.

Of course, further tubes subjected to tension or pressure can be added to the pull string 2 shown in FIGS. 3 and 4 so that the overall length of the structure can be further reduced. The next addition to the pull string 2 in FIGS. 3 and 4 would be a fourth tube subjected to tension and joined at its forward end to the third tube, while its rearward end has a mounting flange.

Instead of the embodiment illustrated by FIGS. 3 and 4 comprising a central tension tube 22 with tubes arranged concentrically thereabout, a flat rod of rectangular cross section can be used which is alternately sawed from opposite ends and, when seen from the top, has a cross section similar to those illustrated by FIGS. 3 and 4.

Figure 2:
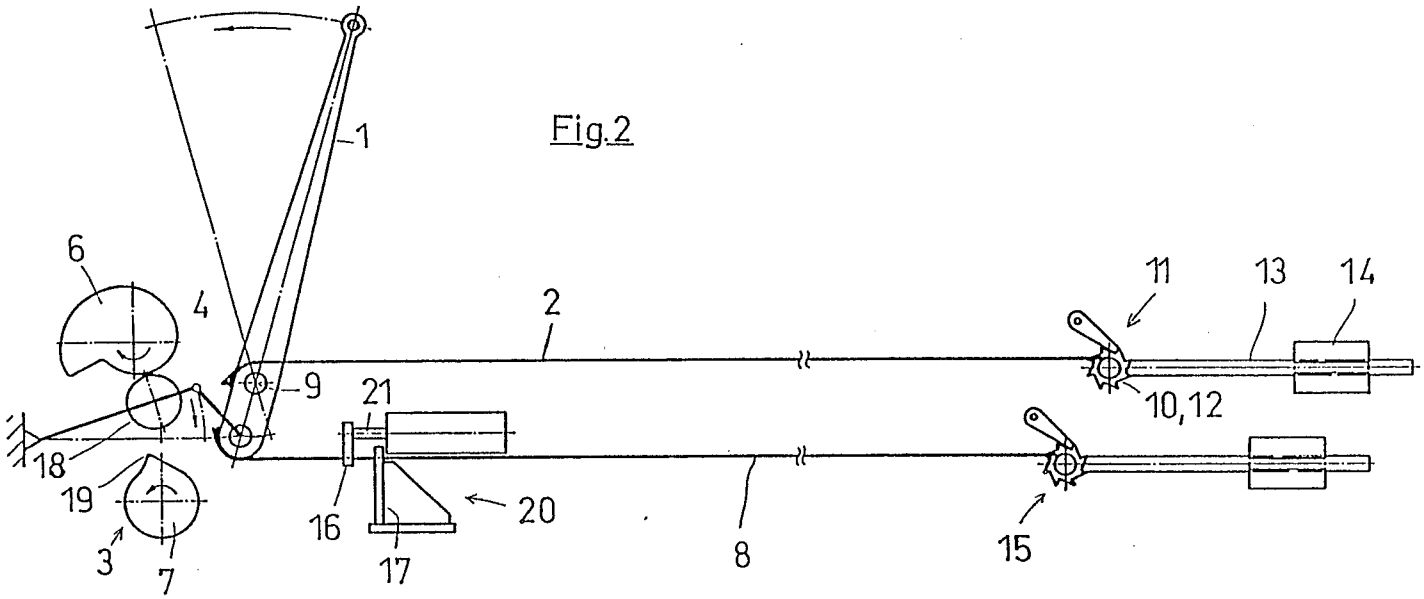
FIG. 2 shows the picking motion after the shuttle has been shot off.
Figure 5:
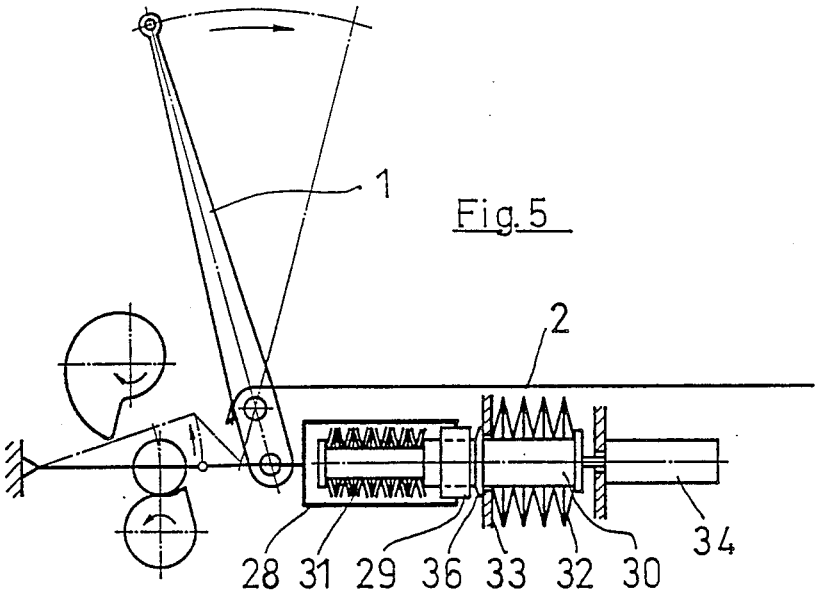
FIG. 5 shows the picking motion with another embodiment of the decelerating means in tensioned state.
Figure 6:
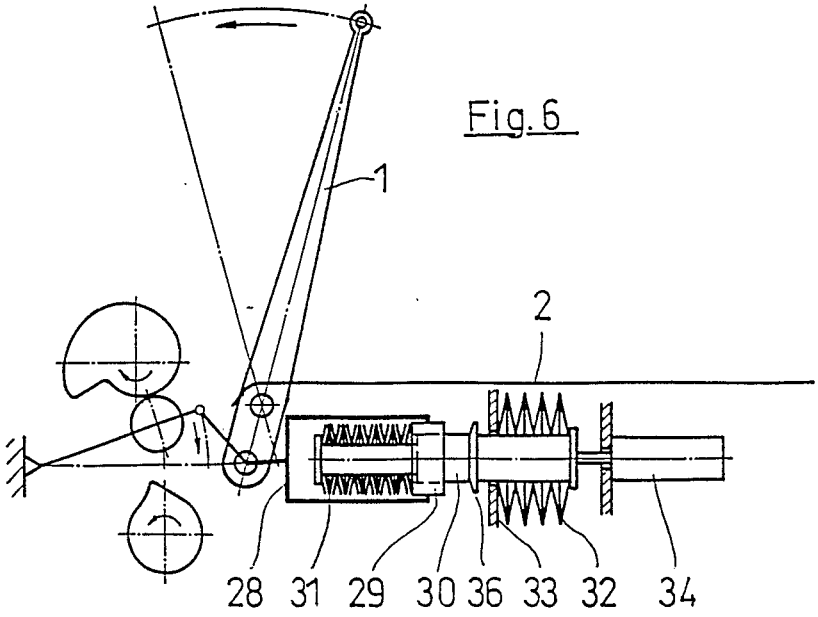
FIG. 6 shows the picking motion of FIG. 5 after the shuttle has been shot off.

FIGS. 5 and 6 show another form of the decelerating string 8 and of the shock absorber 20 in the embodiment illustrated by FIGS. 1 and 2. The decelerating means consists of a decelerating rod 28 hingedly connecting the lower end of the pivot arm 1 to an abutment 29. The abutment 29 is slidable on a shaft 30 which, in turn, is seated slidably in a support 33. At the forward end of the shaft near the pivot arm 1 a first package 31 of cup springs is clamped. At the rear end of the shaft 30 a second package 32 of cup springs is arranged which is clamped between the support 33 and the rear end of the shaft 30, so that a shoulder 36 of the shaft 30 is urged against the front side of the support 33. The prestress of the second package 32 of cup springs is less than that of the first package 31 of cup springs. Furthermore, a shock absorber 34 operatively engages the rear end of the shaft 30.

During the acceleration phase of the pivot arm 1 the abutment 29 slides on the shaft 30 forwardly (to the left side in FIGS. 5 and 6), and at the end of the accelerating phase it rests against the prestressed package 31 of cup springs which is thereby compressed. Thus, the spring force becomes effective in decelerating the pivot arm 1. Since the first package 31 of cup springs is under higher prestress than is the second package 32 of cup springs, the shaft 30, together with the piston rod of the shock absorber 34 fastened thereto, is accelerated in forward direction. When the first package 31 of cup springs has been compressed by about 14 mm, the abutment 29, the shaft 30, and the piston rod have the same velocity, and the decelerating effect of the second package 32 of cup springs becomes active. The shock absorber 34 is active only in response to pressure and dampens the rebound of the pivot arm 1 at the end of the decelerating phase.

The advantage of this decelerating means over the decelerating string shown in FIGS. 1 and 2 resides in the fact that the whip crack is avoided which is caused when the forward portion of the decelerating string tightens during the acceleration phase. Moreover, the abrupt acceleration of the piston rod 21 is avoided. Yet, in the decelerating means shown in FIGS. 5 and 6 the mass to be accelerated is increased by the two decelerating rods 28 and the abutment 29.

Figure 7:
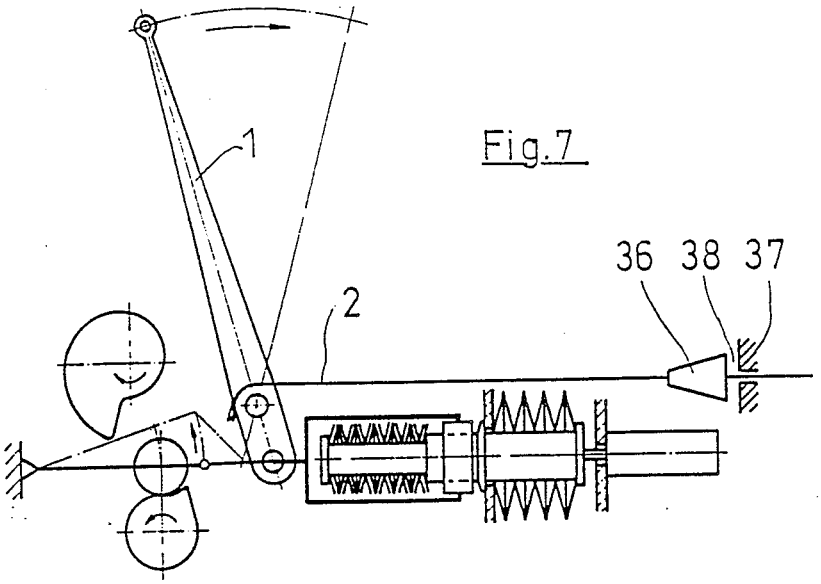
FIG. 7 shows the picking motion of still another embodiment of the picking device in the tensioned state.
Figure 8:
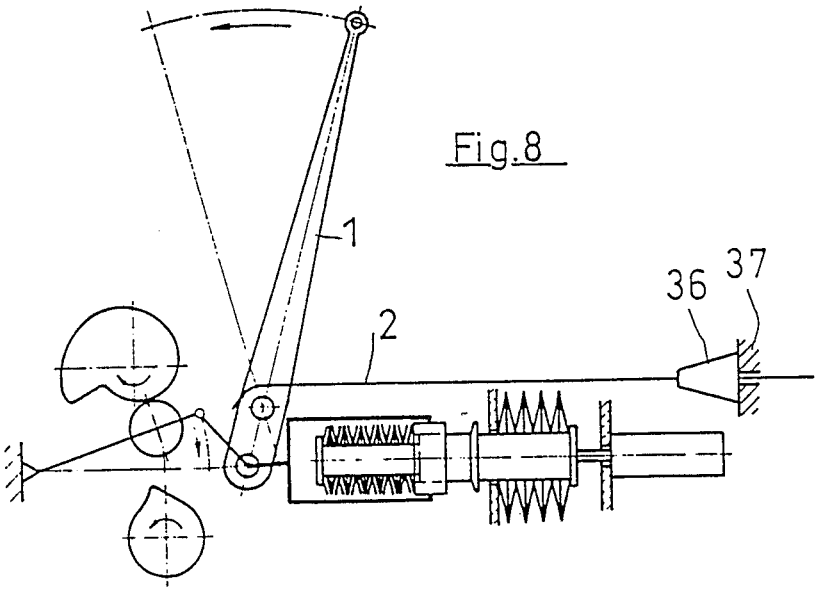
FIG. 8 shows the picking device of FIG. 7 after the shuttle has been shot off.

FIGS. 7 and 8 show an embodiment of the pull string 2 wherein the force exerted by the pull string 2 on the pivot arm 1 falls off sharply immediately after the time of propulsion of the shuttle. To that end, a stop 36 is mounted on the pull string 2 and the frame of the picking device has an abutment 37 cooperating with the stop which is located at the side of the stop 36 opposite the pivot arm 1 at a spacing 38 from the stop 36. The spacing 38 is selected such that the stop 36 rests against the abutment 37 when the pivot arm 1 has accelerated the shuttle to the maximum velocity and the decelerating means begins to act. The force produced after that time by the pull string 2 is thereby taken up by the abutment 37 and no longer acts on the pivot arm 1 and via the same on the decelerating means.

The smaller the spacing is between the pivot arm 1 and the stop 36 the sharper the force acting on the pivot arm 1 falls off at the end of the acceleration phase.

In order to be able to adjust the time at which the stop 36 rests against the abutment 37, the abutment 37 is designed to be slidably mounted on the frame. A lengthening occurring in the pull string 2 after protracted operating time can thereby also be compensated for.

By mounting the stop 36 and the abutment 37 on the pull string 2, the load on the deceleration means is relieved and the ratio of acceleration path to deceleration path of the pivot arm 1 can also be distributed different from above in connection with the embodiment of FIGS. 1 and 2; the acceleration path can be lengthened and the deceleration path shortened.

What is claimed is:

1. A picking device for the picking motion of a loom comprising a support, a pivot arm pivoted on said support at a pivot point, a pull string connected to said pivot arm for delivering energy for a pick to said pivot arm, cam means for tensioning said pull string and decelerating means for decelerating the pivot arm at the end of the pick, said decelerating means including a decelerating string connected to said pivot arm at a point spaced from said pivot point and having a stop mounted thereon a small distance from said pivot arm for engagement with said support when said pull string is tensioned.

2. A picking device according to claim 1, wherein the decelerating means further includes a shock absorber having a piston rod connected to said stop, said shock absorber acting unilaterally and only in response to pressure whereby the piston rod is pulled while the decelerating string decelerates the pivot arm and allows the pivot arm to bounce back at reduced speed after the deceleration is terminated.

3. A picking device for the picking motion of a loom according to claim 1, wherein said pull string is comprised of high tenacity aramide fibers.

4. A picking device according to claim 1, wherein a stop is mounted on the pull string which rests against an abutment on said support about at that time at which the pivot arm has accelerated the shuttle to maximum velocity.

5. A picking device for the picking motion of a loom comprising a support, a pivot arm pivoted on said support at a pivot point, a pull string connected to said pivot arm for delivery energy for a pick to said pivot arm, cam means for tensioning said pull string and decelerating means for decelerating the pivot arm at the end of the pick, said decelerating means including decelerating rods connecting the end of the pivot arm at a point spaced from said pivot point to an abutment which is slidably supported on a shaft movably mounted on said support, a prestressed first package of cup strings arranged at the forward end of said shaft between said abutment and a flange on an end of said shaft, a second package of cup strings on said shaft between said support and a flange on the opposite end of said shaft for biasing a shoulder on said shaft against the support in a direction opposite to the decelerating movement and shock absorber means connected to said shaft for damping the rebound of the pivot arm.

6. A picking device according to claim 5, wherein a stop is mounted on the pull string which rests against an abutment on said support about at the time at which the pivot arm has accelerated the shuttle to maximum velocity.

7. A picking device according to claim 5, wherein the pull string is comprised of high tenacity aramide fibers.

* * * * *